US010128600B2

(12) United States Patent
Yu et al.

(10) Patent No.: US 10,128,600 B2
(45) Date of Patent: Nov. 13, 2018

(54) CONNECTION TERMINAL AND CONNECTOR

(71) Applicant: TYCO ELECTRONICS (SHANGHAI) CO. LTD., Shanghai (CN)

(72) Inventors: Xiaopeng Yu, Shanghai (CN); Weidong Zhang, Shanghai (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 15/832,039

(22) Filed: Dec. 5, 2017

(65) Prior Publication Data

US 2018/0159256 A1 Jun. 7, 2018

(30) Foreign Application Priority Data

Dec. 6, 2016 (CN) ..... 2016 1 1110593

(51) Int. Cl.

| | |
|---|---|
| ***H01R 13/04*** | (2006.01) |
| ***H01R 13/40*** | (2006.01) |
| ***H01R 43/16*** | (2006.01) |
| *H01R 4/18* | (2006.01) |

(52) U.S. Cl.

CPC ..... *H01R 13/04* (2013.01); *H01R 13/40* (2013.01); *H01R 43/16* (2013.01); *H01R 4/184* (2013.01)

(58) Field of Classification Search

CPC ..... H01R 13/04; H01R 4/184; H01R 13/40
USPC ..... 439/877, 884
See application file for complete search history.

(56) References Cited

U.S. PATENT DOCUMENTS

| | | | | |
|---|---|---|---|---|
| 5,989,080 | A * | 11/1999 | Tsuji | H01R 13/055 439/877 |
| 6,217,379 | B1 * | 4/2001 | D'Hulster | H01R 13/04 439/595 |
| 6,790,105 | B2 * | 9/2004 | Fukatsu | H01R 13/055 439/884 |
| 6,790,106 | B2 * | 9/2004 | Ito | H01R 13/04 439/866 |
| 7,713,100 | B2 * | 5/2010 | Hernandez | H01R 13/055 439/850 |
| 8,241,078 | B2 * | 8/2012 | Tsuji | H01R 4/185 439/884 |
| 9,281,596 | B2 * | 3/2016 | Endo | H01R 13/213 |

(Continued)

*Primary Examiner* — Tulsidas C Patel
*Assistant Examiner* — Travis Chambers
(74) *Attorney, Agent, or Firm* — Saxton & Stump LLC

(57) ABSTRACT

The present disclosure discloses a connection terminal and a connector. The connection terminal comprises a terminal body, a plug-in part, and a stop part. The plug-in part is disposed at an axial front end of the terminal body and extends along an axial direction of the terminal body to enable a plug-fit with a mating terminal. The stop part is disposed at an axial front end of the terminal body for stopping the connection terminal from a continued forward insertion when the connection terminal is mounted in place in a connector housing. The stop part extends along a radial direction of the terminal body and is arranged to be stop-fittable with a rear end of the plug-in part along the axial direction of the terminal body. The connection terminal according to the present disclosure has a simplified structure with good processability and high mechanical strength.

20 Claims, 9 Drawing Sheets

(56) References Cited

U.S. PATENT DOCUMENTS

2015/0229038 A1* 8/2015 Nagasaka ..... H01R 43/16
439/877

* cited by examiner

CONNECTION TERMINAL AND CONNECTOR

TECHNICAL FIELD

The present invention relates to a connection structure, and more particularly to a connection terminal and a connector.

BACKGROUND

Electric connection grows increasingly important in production and life. A connection terminal as an important electric connection component is used for implementing an electric connection between different electronic devices. However, the existing connection terminals generally have a relatively complex manufacturing process, such that the corresponding manufacturing cost is relatively high, which impedes promotion and application. In addition, vibration issues easily occur in some application environments.

SUMMARY OF THE INVENTION

One of the objectives of the present disclosure is to provide a connection terminal and a connector having a simplified structure with good processability and high mechanical strength, thereby overcoming the above drawbacks of the prior art.

According to a first aspect of the present disclosure, there is provided a connection terminal. The connection terminal comprises a terminal body, a plug-in part, and a stop part. The plug-in part is disposed at an axial front end of the terminal body and extends along an axial direction of the terminal body such that the plug-in part may be plug-fitted with a mating terminal. The stop part is disposed at an axial front end of the terminal body for stopping the connection terminal from continued forward insertion when the connection terminal is mounted in place in a connector housing. The stop part extends along a radial direction of the terminal body and is arrangeable to be stop-fitted with a rear end of the plug-in part along the axial direction of the terminal body.

Preferably, the terminal body has a notch. The notch is disposed at either or both sides of the stop part.

Preferably, the terminal body has a body bottom wall, a body top wall, and a body side wall. The body bottom wall, the body side wall, and the body top wall are successively connected to enclose a cavity. More preferably, one end of the stop part is disposed at a front end of the body top wall and arranged to extend downwardly.

Preferably, the connection terminal further comprises a retaining part. The retaining part is arranged to continuously extend from the rear end of the plug-in part.

Preferably, at least part of the retaining part extends to a rear side of the stop part and is arrangeable to be axially stop-fitted with the stop part.

Preferably, the retaining part is disposed apart from the stop part with a gap.

Preferably, the terminal body has a body side wall. One side wall or two side walls of the retaining part is integrally connected with the body side wall of the terminal body.

Preferably, the retaining part extends towards a top portion of the terminal body. The stop part continuously extends towards the plug-in part from the top portion of the terminal body, and the stop has a larger tilt angle than that of the retaining part.

Preferably, the terminal body has a body bottom wall. The plug-in part has a connection bottom portion. A rear end of the connection bottom portion continuously extends towards and is connected to a front end of the body bottom wall.

Preferably, a top end of the retaining part is provided with a limiting bottom wall. A bottom end of the stop part is arranged to directly face a limiting top wall thereby to be enabled to be stop-fitted with the limiting bottom wall along the radial direction of the terminal body. More preferably, limiting sidewalls are provided at two sides of the limiting bottom wall. The limiting sidewalls and the limiting bottom wall enclose a notch. The bottom end of the stop part extends into the notch and is stop-fittable with the limiting sidewalls along a lateral direction of the terminal body.

Preferably, a retaining recess depressed inwardly is provided on a front surface of the retaining part. Part of the stop part extends into the retaining recess. More preferably, the retaining part is provided with a retaining recess bottom wall. The retaining recess bottom wall may be stop-fitted with the bottom end of the stop part along a radial direction of the terminal body. More preferably, the retaining part is provided with a retaining recess side wall. The retaining recess side wall may be stop-fitted with a side wall of the stop part along a lateral direction of the terminal body. More preferably, the retaining part is provided with a retaining recess rear wall. The retaining recess rear wall may be stop-fitted with the stop part along an axial direction of the terminal body. More preferably, the retaining recess extends rearwardly to form an opening at a top end wall of the retaining part. The stop part extends from the opening into the retaining recess. More preferably, the retaining recess is a stamped structure.

The connection terminal as described above is preferably an integral element. More preferably, the connection terminal is a male terminal.

According a second aspect of the present disclosure, there is further provided a connector. The connector comprises a connector housing and a connection terminal according to any of the abovementioned. A terminal-receiving cavity is provided in the connector housing. The connection terminal is inserted and secured within the terminal-receiving cavity.

Compared with the prior art, the stop part of the connection terminal of the present disclosure can block a continued forward insertion when the connection terminal is inserted to a preset position, thereby avoiding damaging the connection terminal and its mating structure. The stop part extends to be stop-fitted with the plug-in part along an axial direction, which enhances performance of limiting and retaining the stop part and avoids breakage of the stop part. Correspondingly, the connection terminal can achieve a greater mechanical intensity without adopting a special structure or a material with a corresponding hardness, thereby enhancing universality. Specifically, the connection terminal is manufactured with a relatively soft copper material, which not only achieves relatively strong current-carrying performance, but also can overcome the drawback of insufficient mechanical strength. Additionally, the connection terminal is integrally formed, which may reduce manufacturing costs.

DETAILED DESCRIPTION OF THE INVENTION

Hereinafter, the present disclosure will be described in detail with reference to the accompanying drawings:

Embodiment 1

Figure 1:
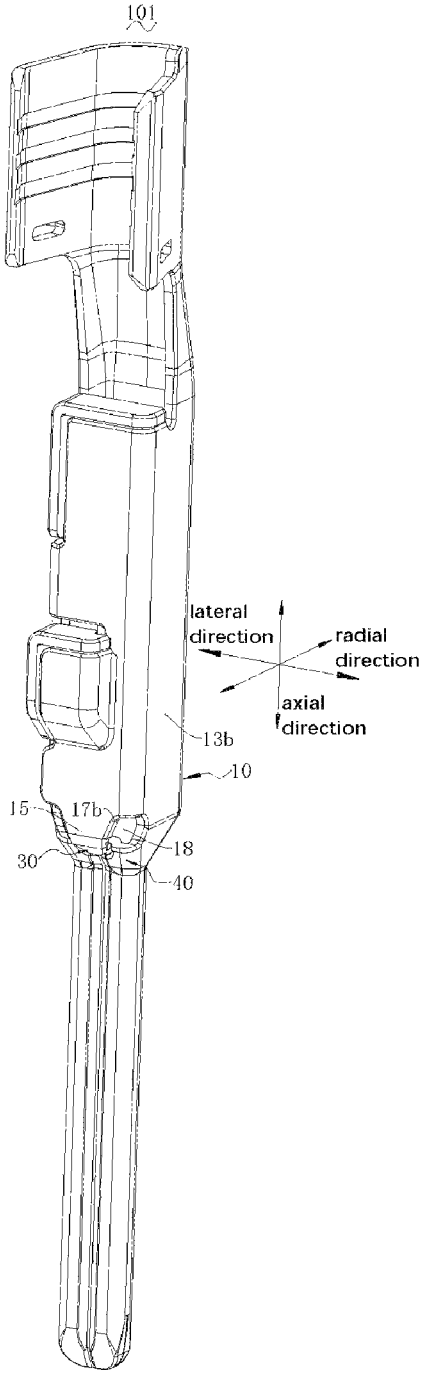
FIG. 1 is a stereo structural schematic diagram of a connection terminal provided by the present disclosure.
Figure 2:
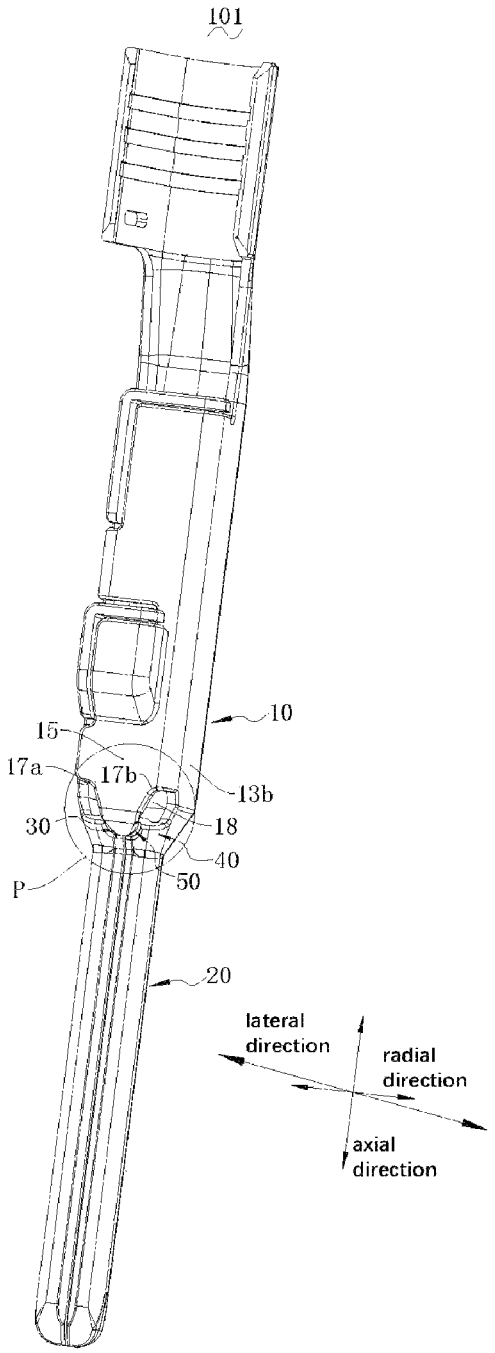
FIG. 2 is a stereo structural schematic diagram of the connection terminal of FIG. 1 from another perspective.
Figure 3:
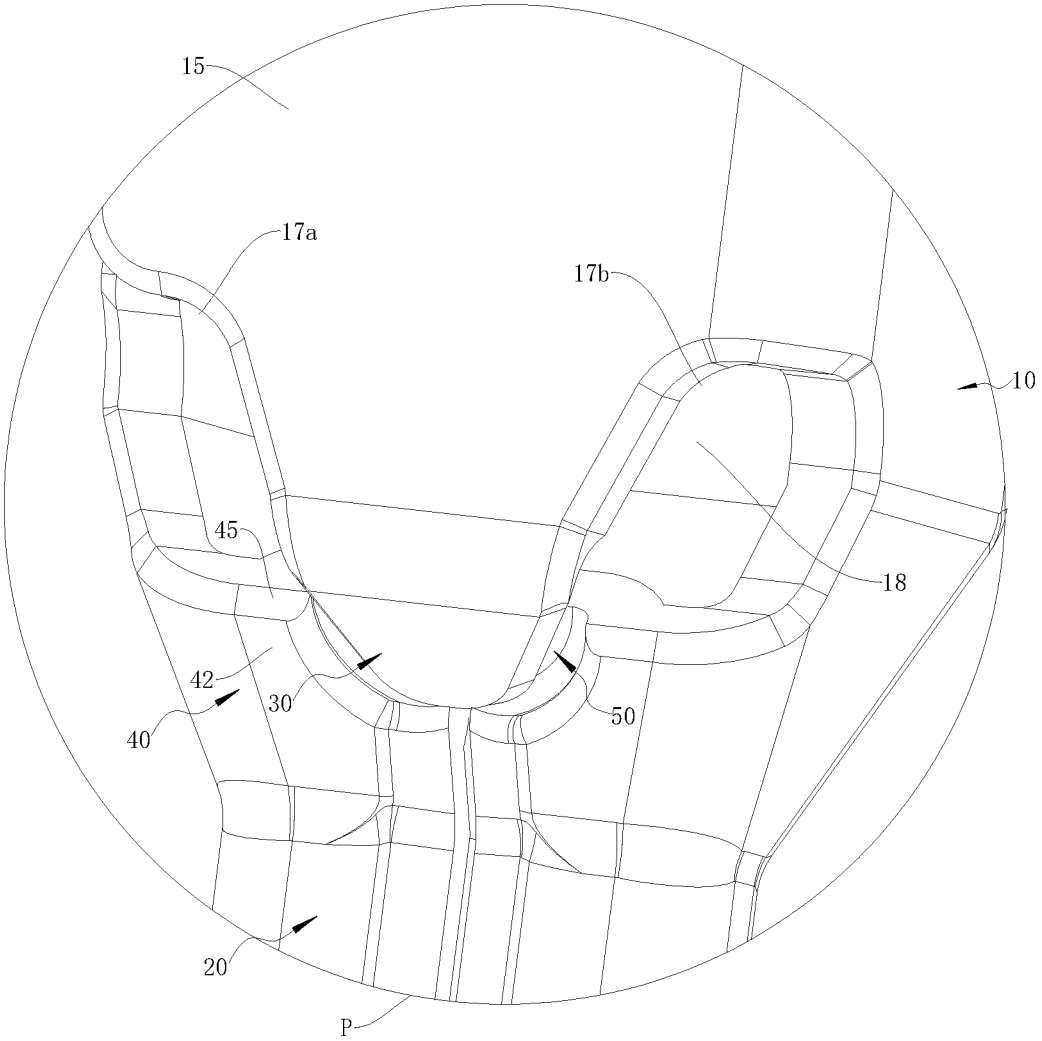
FIG. 3 is an enlarged schematic view of the connection terminal of FIG. 2 at a position P.

With reference to FIGS. 1 to 3, a connection terminal 101 provided by the present disclosure is shown. The connection terminal 101 comprises a terminal body 10, a plug-in part 20, and a stop part 30. The plug-in part 20 is provided at an axial front end of the terminal body 10. The stop part 30 is provided at an axial front end of the terminal body 10 and extends to be stop-fitted with the plug-in part 20.

Figure 4:
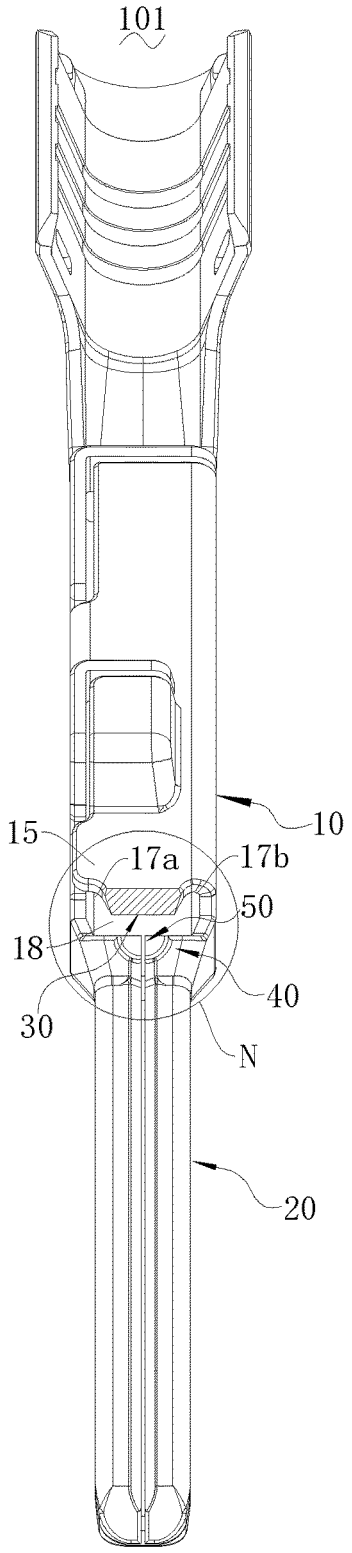
FIG. 4 is a sectional view of the connection terminal of FIG. 2 when part of a stop part is cut off.
Figure 7:
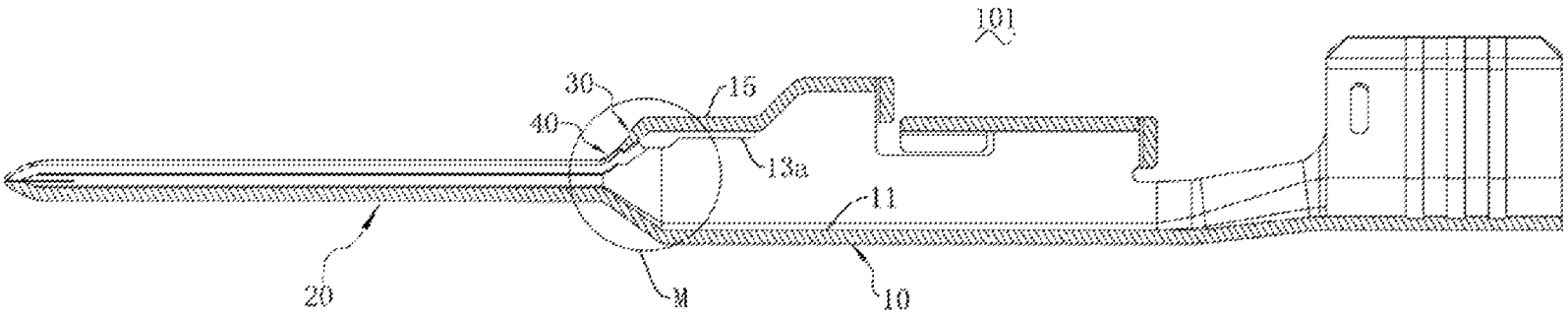
FIG. 7 is a sectional view of the connection terminal of FIG. 6 along a line A-A.
Figure 8:
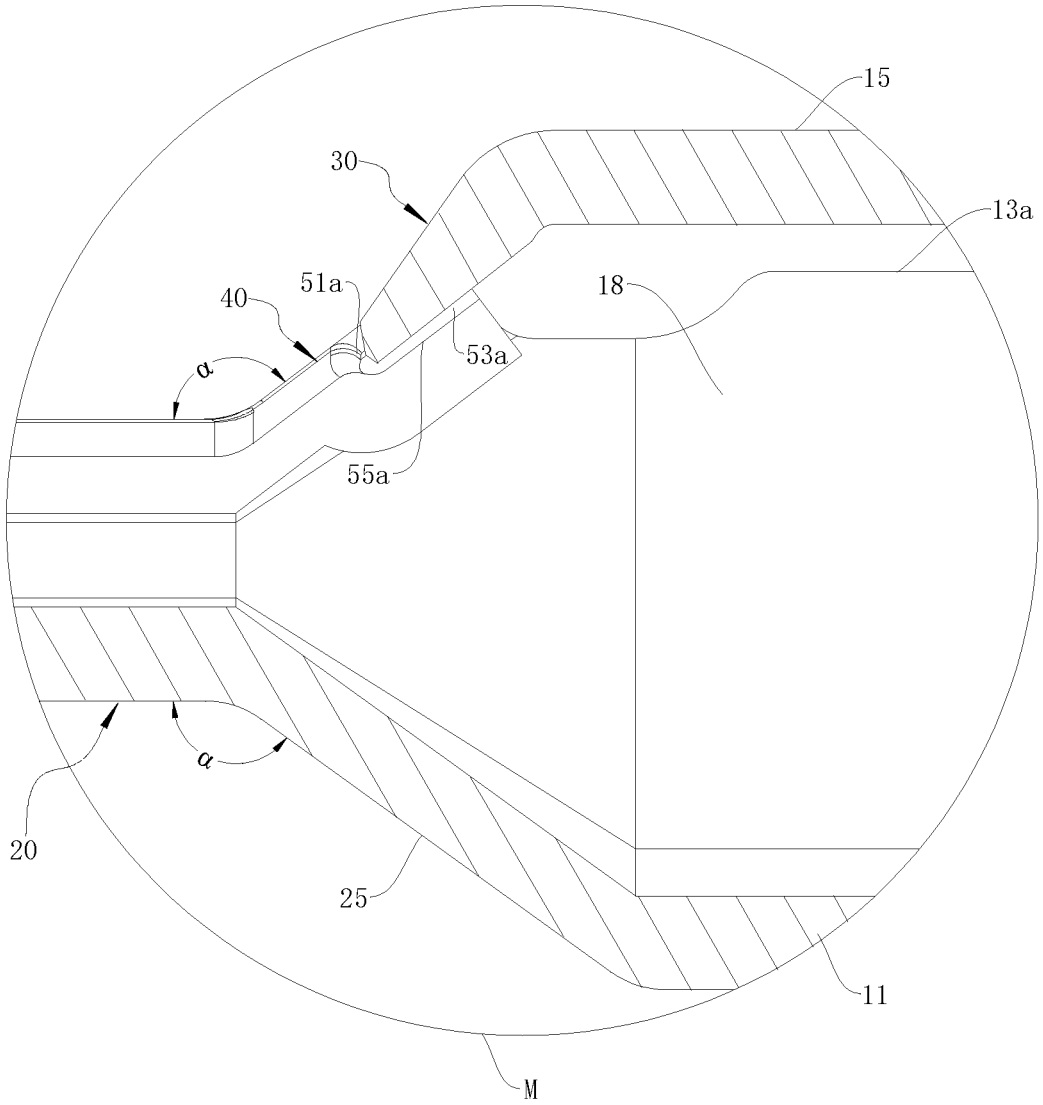
FIG. 8 is an enlarged view of the connection terminal of FIG. 7 at a position M.
Figure 9:
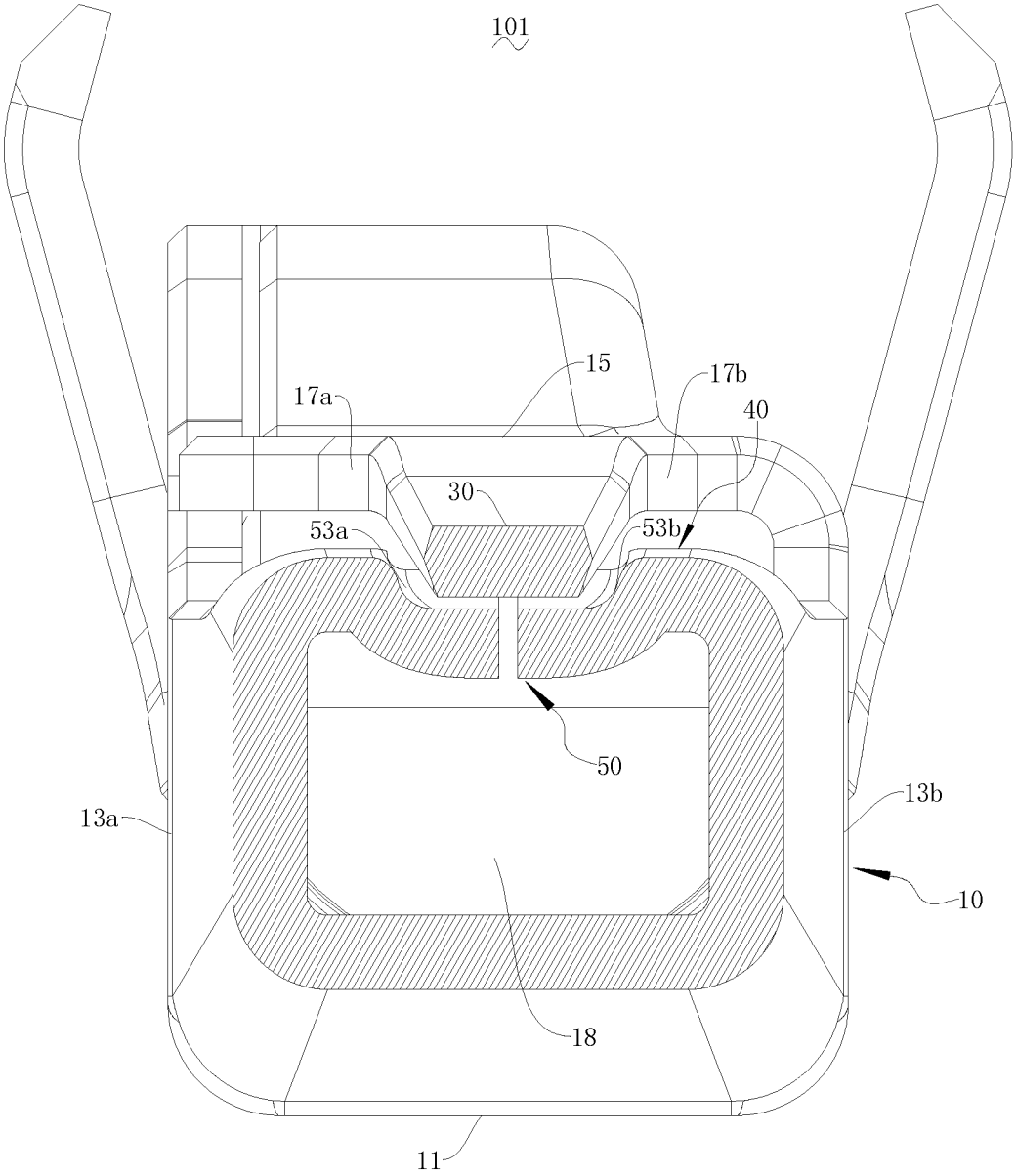
FIG. 9 is a sectional view of the connection terminal of FIG. 6 along a line B-B.

It should be noted that for the directions indicated by arrows in FIG. 1 and FIG. 2, unless otherwise indicated, the term "axial/axial direction" mentioned herein refers to a length direction of the connection terminal 101; the term "lateral direction" refers to a left-right direction indicated in FIG. 4; the term "radial/radial direction" refers to an up-down direction indicated in FIG. 7. Additionally, the term "front" is opposite to the term "rear," wherein a "front" direction refers to a direction along which the connection terminal 101 implements a plug connection; the term "top" is opposite to the term "bottom"; and the term "upper" is opposite to "lower." The directional limitations described are only for clearly expressing relative positions of various components with reference to the drawings, rather than limiting the protection scope of the present disclosure.

Figure 5:
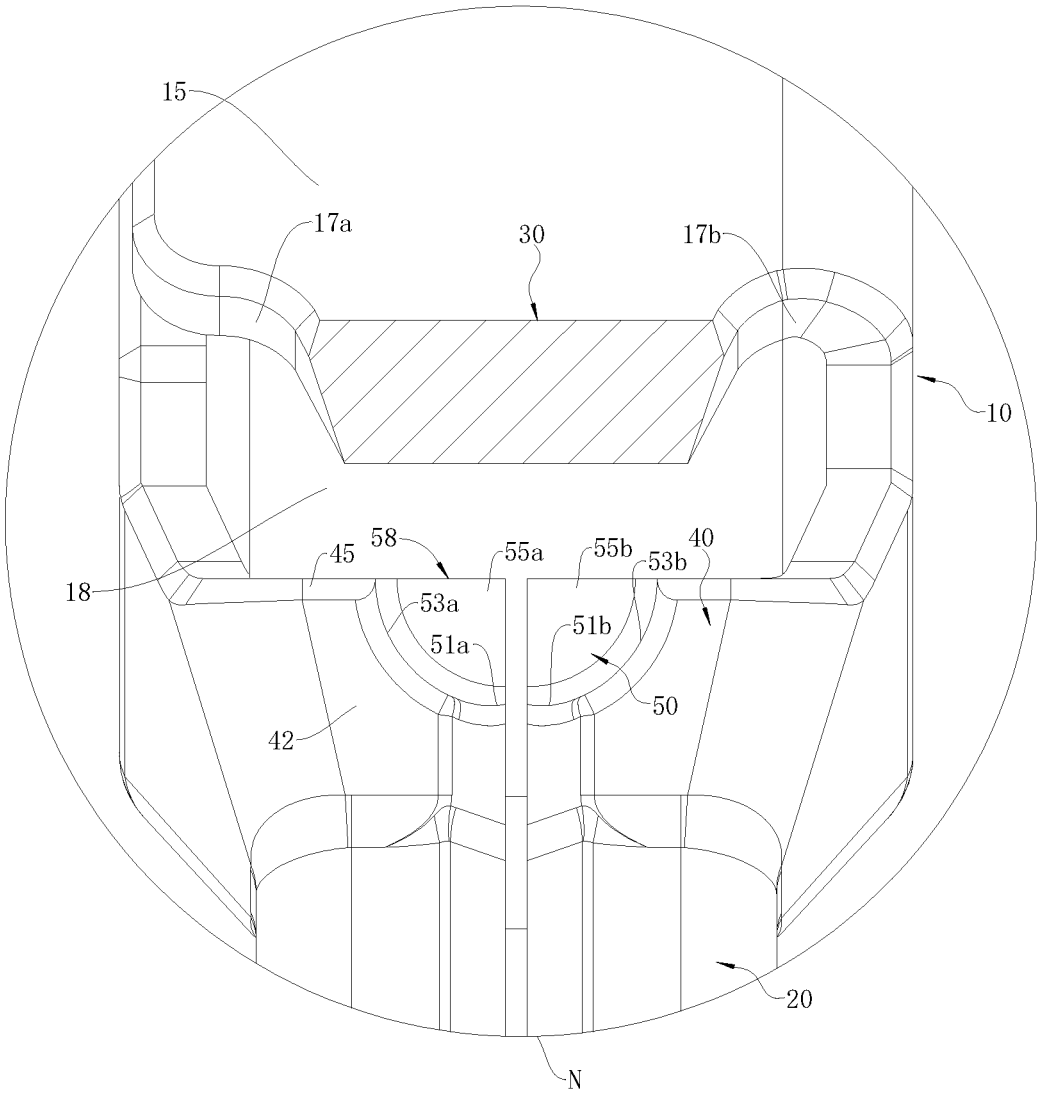
FIG. 5 is an enlarged view of the connection terminal of FIG. 4 at a position N.

With reference to FIGS. 4 and 5 together, a specific shape and structure of the terminal body 10 are only required satisfying application needs. In the present embodiment, to facilitate implementation of a plug connection, the terminal body 10 is arranged to extend along an axial direction of the connection terminal 101. An outer profile of the terminal body 10 is substantially rectangular column shaped. In this embodiment, the terminal body 10 comprises a body bottom wall 11, body side walls 13*a*, 13*b*, and a body top wall 15. One of the body side walls 13*a*, the body bottom wall 11, the other of the body side walls 13*b*, and the body top wall 15 are connected in succession. The terminal body 10 has a receiving cavity 18 enclosed by the body bottom wall 11, the body side walls 13*a*, 13*b*, and the body top wall 15. Namely, the terminal body 10 is in a shape of a cylinder having a middle through-hole. More specifically, the body 10 is rectangular cylinder shaped. The terminal body 10 is formed by bending an entire metal plate into the body bottom wall 11, the body side walls 13*a*, 13*b*, and the body top wall 15. Moreover, the body top wall 15 laterally extends from one of the body side walls 13*b*. To enhance the mechanical strength, part of the body top wall 15 extends to be contactable with the other of the body side walls 13*a* along a radial direction. To simplify the manufacturing process and lower processing difficulty and thereby facilitate manufacturing of the stop part 30, notches 17*a*, 17*b* are provided on the terminal body 10. The notches 17*a*, 17*b* are disposed at two sides of the stop part 30, respectively. Specifically, the notches 17*a*, 17*b* may be formed at two sides of a front end of the body top wall 15 and/or at a top portion of the front end of the body side wall 10.

One end of the plug-in part 20 is provided on an axial front end of the terminal body 10, and the other end thereof is arranged to extend along an axial direction of the terminal body 10 to enable a plug-fit with a mating terminal (not shown). A specific shape of the plug-in part 20 may be selected according to application needs, so long as it can be fitted with the mating terminal to implement an electric connection. In this embodiment, the plug-in part 20 is substantially in a shape of a plate with a pointed end. In this embodiment, the plug-in part 20 is formed by bending an entire metal plate, forming two symmetrical upper arch faces. To facilitate plug-in, the plug-in part 20 has a cross-sectional area and dimension smaller than that of the terminal body 10. The plug-in part 20 is substantially provided on a central axis of the terminal body 10. To sufficiently utilize space, tail portions of the plug-in part 20 are connected with the body bottom wall 11, respectively. To enhance the stability, the tail portions of the plug-in part 20 are connected to the body side walls 13*a*, 13*b*. To transition smoothly, junction portions of the plug-in part 20 with the body bottom wall 11 and the body side walls 13*a*, 13*b* are configured to be conical faces. In this embodiment, the connection terminal 101 is a male terminal. Correspondingly, the one mated with the connection terminal 101 is a female terminal.

To enhance stability of the connection terminal 101, the plug-in part 20 has a connection bottom portion 25. The connection bottom portion 25 is connected to a front end of the body bottom wall 11. A rear end of the connection bottom portion 25 continuously extends towards and is connected to the front end of the body bottom wall 11. The connection bottom portion 25 is arranged to obliquely extend upwards along a plug-in direction of the connection terminal 101. To facilitate manufacturing a simplified mating structure (e.g., a mating terminal or a mounting housing) and facilitate mating, a tilt angle of the connection bottom portion 25 corresponds to a tilt angle of the retaining part 40. As shown in FIG. 7, an angle $\alpha$ in the figure is an included angle between the connection bottom portion 25 and the retaining part 40 relative to the axially extending plug-in part 20.

The stop part 30 is provided on a front end portion of the terminal body 10 and extends along a radial direction of the terminal body 10. Along the axial direction of the terminal body 10, the stop part 30 is arranged to extend to be stop-fittable with the rear end of the plug-in part 20. The stop part 30 has a lateral size smaller than that of the terminal body 10. To keep balanced forces, the stop part 30 is provided in a lateral middle of the front end portion of the terminal body 10. Specifically, the stop part 30 continuously extends from the body top wall 15. Namely, one end of the stop part 30 is provided on the body top wall 15 and extends downwardly. Specifically, the stop part 30 is arranged to obliquely extend towards a lower front direction of the terminal body 10. The stop part 30 may be stop-fitted with a mounted object when plug-fitting, to thereby block the connection terminal 101 from continued forward plug-in, and meanwhile to assign a feedback force indicating an in-place assembly. In this embodiment, the stop part 30 and the body top wall 11 are integrally formed. Specifically, the stop part 30 is arranged to continuously extend from the front end of the body top wall 15 and then formed by being bent downwardly. To facilitate forming a stable support, the stop part 30 is substantially triangular plate shaped or hump shaped. The notches 17*a*, 17*b* are provided at two sides of the stop part 30, thereby facilitating zigzag bending to form the stop part 30. To achieve a stable, the other end of the stop part 30 extends to be stop-fittable with tail portions of the plug-in part 20 along the axial direction of the terminal body 10. Specifically, the stop part 30 and the tail portions of the plug-in part 20 form a partial overlap on a cross-section of the terminal body 10, such that projections along the axial direction of the terminal body 10 form the partial overlap. At this point, when the stop part 30 is subjected to an axial rearward external force, it may be moved to contact the plug-in part 20 till abutting. Correspondingly, the stop part 30 may be provided to contact with the plug-in part 20 or axially spaced therefrom. In this embodiment, part of the stop part 30 extends into the retaining recess 50 described below.

Figure 6:
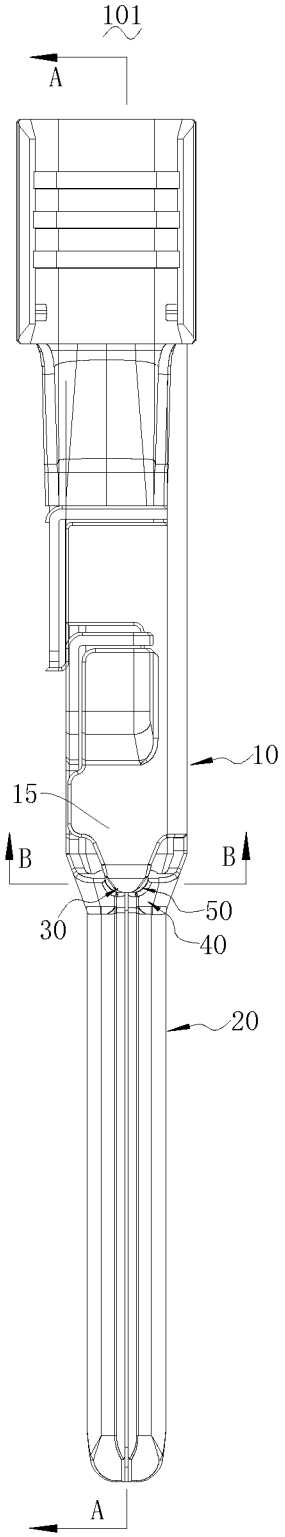
FIG. 6 is a projected view of the connection terminal of FIG. 2 from a body top wall to a body bottom wall.

To enhance pressure-bearing performance and shorten an axial length of the connection terminal 101, the tilt angle of the stop part 30 is greater than the tilt angle of the retaining part 40 described below, as shown in FIG. 6. In other words, a rear end face of the stop part 30 is parallel to the retaining recess rear wall 55*a*, 55*b* described below, while a front end face of the stop part 30 is steeper than a recessed rear wall 55.

With reference to FIGS. 6 to 9 together, to enhance the performance of limiting and retaining the stop part 30, a retaining part 40 is provided at a tail portion of the plug-in part 20. The retaining part 40 is not essential and is only for the purpose of further enhancing the retaining of the stop part 30, so as to provide support to the stop part 30 in some possible scenarios. The retaining part 40 is arranged to protrude along the radial direction of the terminal body 10, with one end continuously extending to be disposed at a rear side of the stop part 30. The specific structure of the retaining part 40 is only required to be capable of blocking an excessive rearward movement of the stop part 30 along the axial direction of the terminal body 10, thereby avoiding an excessive deformation of the stop part 30 which causes occurrences of irrecoverable deformation or even breakage. To enhance the retaining performance, the retaining part 40 has a lateral size greater than that of the stop part 30. In this embodiment, two (or one) sides of the retaining part 40 extend to be integrally connected with the body side walls 13*a*, 13*b*. To provide a certain movement space when the connection terminal 101 is plug-fitted to a final position, the retaining part 40 obliquely extends along a rear upward direction of the body.

To further enhance the performance of limiting and retaining the stop part 30, a rearwardly collapsed retaining recess 50 is provided on a front surface 42 of the retaining part 40. The retaining recess 50 is a stamped structure. In other words, to enhance the mechanical strength and simplify the processing, the retaining recess 50 is formed by stamping on the retaining part 40. To receive the stop part 30 as much as possible and avoid the stop part 30 from entering during movement, the retaining recess 50 extends to a top end wall 45 of the retaining part 40 and forms an opening 58 on the top end wall 45.

To radially enhance the performance of limiting, retaining, and supporting the stop part 30, the retaining recess 50 has retaining recessed bottom walls 51*a*, 51*b*. The retaining recessed bottom walls 51*a*, 51*b* are provided to directly face a bottom end of the stop part 30, so as to be radially stop-fitted with the stop part 30. In other words, when the stop part 30 is excessively pressed downwardly, the retaining recessed bottom walls 51*a*, 51*b* support the stop part 30. The retaining recessed bottom walls 51*a*, 51*b* are provided at the utmost front end of the retaining part 40.

To laterally enhance the performance of limiting and retaining the stop part 30, the retaining recess 50 further has retaining recessed side walls 53*a*, 53*b*. The retaining recessed side walls 53*a*, 53*b* are provided at two sides of the retaining recessed bottom walls 51*a*, 51*b*, respectively. Upon stop-fitting, the retaining recessed side walls 53*a*, 53*b* are disposed at two sides of the stop part 30, respectively, so as to be laterally stop-fitted with the stop part 30. The two retaining recessed side walls 53*a*, 53*b* are symmetrically provided and extend into an arc shape.

To axially enhance the performance of limiting, retaining, and supporting the stop part 30, the retaining recess 50 has retaining recessed rear walls 55*a*, 55*b*. The retaining recessed rear walls 55*a*, 55*b* may be axially stop-fitted with the stop part 30. In other words, when the stop part 30 is subjected to an axially rearward external force, the retaining recess rear walls 55*a*, 55*b* may contact with or abut against the stop part 30. Of course, when the stop part 30 is not forced, the retaining recessed rear walls 55*a*, 55*b* may be provided to be axially spaced apart from the stop part 30, thereby providing the stop part 30 with a certain movement space so as to provide a relatively appropriate feedback force when mounted in place. It may be understood that the retaining recessed bottom walls 51*a*, 51*b* are connected to the retaining recessed side walls 53*a*, 53*b*, and extend along a periphery of the retaining recess 50 to form the retaining recessed side walls. The retaining recessed rear walls 55*a*, 55*b* act as the retaining recessed bottom portion that is a main portion of the retaining recess 50. In this embodiment, the retaining recessed rear walls 55*a*, 55*b* are flat plates inclining downwardly along a plug-in direction of the connection terminal 101.

As discussed above, the retaining recessed rear walls 55*a*, 55*b* are used for providing performance of supporting and retaining the stop part 30 when the stop part 30 is excessively pressed downwardly in some conditions. Therefore, the retaining recessed rear walls 55*a*, 55*b* are not essential. As a variation, a through-hole (not shown) may be provided at positions of the retaining recessed rear walls 55*a*, 55*b*. The through-hole is disposed to directly face the stop part 30, thereby providing a relatively large deformation space for the stop part 30 and saving materials. Correspondingly, the retaining part 40 may be a U-shaped notch. The stop part 30 partially extends into the U-shaped notch. In other words, the retaining part 40 includes limiting side walls (whose specific structure may be retaining recessed side walls 53*a*, 53*b*) and limiting bottom walls (whose specific structure may be retaining recessed bottom walls 51*a*, 51*b*). In other words, when forced, the limiting side walls may be laterally stop-fitted with a bottom end of the stop part 30. When forced, the limiting bottom walls may be radially limiting-fitted with the stop part 30.

In this embodiment, two of the retaining recessed bottom walls 51*a*, 51*b* are provided, and the retaining recessed bottom walls 51*a*, 51*b* are disposed to be spaced apart from the retaining recessed bottom walls 51*a*, 5*ab*. One of the retaining recessed side walls 53*a* is connected to the retaining recessed bottom walls 51*a*, 51*b*. The other of the retaining recessed side walls 53*b* is connected to the retaining recessed bottom walls 51*a*, 51*b*. Two of the retaining recessed rear walls 55*a*, 55*b* are provided, and one of the retaining recessed bottom walls 55*a* is provided to be spaced apart from the other of the retaining recessed bottom walls 55*b*. Specifically, the retaining recess 50 is evenly and symmetrically divided into two portions.

To facilitate an electrical connection with other connection elements or wires, the connection terminal 101 further comprises a connection tail end (no reference number assigned in the figure). The connection tail end is provided at a tail end of the terminal body 10 and extends along an axial direction of the terminal body 10. The specific structure and shape of the connection tail end 60 is only required to maintain a stable connection with the corresponding connection element or wire. In this embodiment, the connection tail end 60 comprises a groove and a retaining wall provided to radially protrude upwardly. The retaining wall may be bent to retain the mating connection element or wire.

To save materials, simplify the manufacturing process, and reduce manufacturing costs, the connection terminal 101 is an integral element. To further save costs, the connection terminal 101 is a copper-made integral element. Specifically, the connection terminal 101 is made by an entire block of brass plate. Therefore, when the connection terminal 101 is made of brass which is relatively soft and inexpensive, it can still achieve relatively strong retaining performance and mechanical strength, has a relatively strong universality, and is easy to promote.

Embodiment 2

The present disclosure further provides a connector (not shown in the figure). The connector comprises the connection terminal 101 as described in Embodiment 1. According to needs, the connector may also comprise a female terminal (not shown in the figure) mating with the connection terminal 101. Of course, the connector may also comprise a corresponding connector housing (not shown in the figure). The connection terminal 101 is provided on the connector housing. The connector housing is provided with a terminal-receiving cavity (not shown in the figure). The connection terminal 101 is inserted and fixed in the terminal-receiving cavity. A specific shape of the connector housing may be selected according to application needs, so long as it can carry the connection terminal 101. The terminal-receiving cavity is only required to hold the corresponding connection terminal 101. When the connector is mounted in place (i.e., assembled at a position satisfying corresponding application needs), the stop part 30 is axially stop-fitted with the connector housing, so as to block the connection terminal 101 from a continued forward insertion.

What have been described above are only preferred embodiments of the present disclosure, and are not intended to limit the protection scope of the present disclosure. Any modifications, equivalent substitutions, improvements or the like within spirit of the present disclosure should be covered within the scope of the claims of the present disclosure.

What is claimed is:

1. A connection terminal, comprising:

a terminal body;

a plug-in part disposed at an axial front end of the terminal body and extending along an axial direction of the terminal body such that the plug-in part is plug-fittable with a mating terminal; and a stop part disposed at an axial front end of the terminal body for stopping the connection terminal from a continued forward insertion when the connection terminal is mounted in place in a connector housing, a front face of the stop part having a tilt angle from a top wall of the terminal body greater than the tilt angle of a rear face of the stop part;

wherein the stop part extends along a radial direction of the terminal body and is arranged to be stop-fittable with a rear end of the plug-in part along the axial direction of the terminal body.

2. The connection terminal according to claim 1, wherein:

the terminal body is formed with a notch; and the notch is disposed at either or both sides of the stop part.

3. The connection terminal according to claim 1, wherein the connection terminal is an integral element.

4. The connection terminal according to claim 1, wherein the connection terminal is a male terminal.

5. The connection terminal according to claim 1, wherein:

the terminal body has a body bottom wall, a body top wall, and a body side wall; and the body bottom wall, the body side wall, and the body top wall are successively connected to enclose a cavity.

6. The connection terminal according to claim 5, wherein one end of the stop part is disposed at a front end of the body top wall and arranged to extend downwardly.

7. The connection terminal according to claim 1, further comprising a retaining part arranged to continuously extend from the rear end of the plug-in part.

8. The connection terminal according to claim 7, wherein the retaining part is disposed to be spaced apart from the stop part.

9. The connection terminal according to claim 7, wherein:

the terminal body has a body side wall;

one side wall or two side walls of the retaining part is integrally connected with the body side wall of the terminal body.

10. The connection terminal according to claim 7, wherein:

the retaining part extends towards a top portion of the terminal body;

the stop part continuously extends towards the plug-in part from the top portion of the terminal body; and the stop part has a larger tilt angle than that of the retaining part.

11. The connection terminal according to claim 7, wherein:

the terminal body has a body bottom wall;

the plug-in part has a connection bottom portion; and a rear end of the connection bottom portion continuously extends towards and is connected to a front end of the body bottom wall.

12. A connection terminal, comprising:

a terminal body;

a plug-in part disposed at an axial front end of the terminal body and extending along an axial direction of the terminal body such that the plug-in part is plug-fittable with a mating terminal; and a stop part disposed at an axial front end of the terminal body for stopping the connection terminal from a continued forward insertion when the connection terminal is mounted in place in a connector housing;

the stop part extends along a radial direction of the terminal body and is arranged to be stop-fittable with a rear end of the plug-in part along the axial direction of the terminal body;

a retaining part arranged to continuously extend from the rear end of the plug-in part, at least part of the retaining part extends to a rear side of the stop part and is arranged to be axially stop-fittable with the stop part.

13. A connection terminal, comprising:

a terminal body;

a plug-in part disposed at an axial front end of the terminal body and extending along an axial direction of the terminal body such that the plug-in part is plug-fittable with a mating terminal; and a stop part disposed at an axial front end of the terminal body for stopping the connection terminal from a continued forward insertion when the connection terminal is mounted in place in a connector housing;

the stop part extends along a radial direction of the terminal body and is arranged to be stop-fittable with a rear end of the plug-in part along the axial direction of the terminal body;

a retaining part arranged to continuously extend from the rear end of the plug-in part;

a top end of the retaining part is provided with a limiting bottom wall; and a bottom end of the stop part is provided to directly face the limiting top wall to enable a stop-fit with the limiting bottom wall along the radial direction of the terminal body.

14. The connection terminal according to claim 13, wherein:

limiting sidewalls are provided at two sides of the limiting bottom wall;

the limiting sidewalls and the limiting bottom wall enclose a notch; and the bottom end of the stop part extends into the notch and is stop-fittable with the limiting sidewalls along a lateral direction of the terminal body.

15. A connection terminal, comprising:

a terminal body;

a plug-in part disposed at an axial front end of the terminal body and extending along an axial direction of the terminal body such that the plug-in part is plug-fittable with a mating terminal; and a stop part disposed at an axial front end of the terminal body for stopping the connection terminal from a continued forward insertion when the connection terminal is mounted in place in a connector housing;

the stop part extends along a radial direction of the terminal body and is arranged to be stop-fittable with a rear end of the plug-in part along the axial direction of the terminal body;

a retaining part arranged to continuously extend from the rear end of the plug-in part;

a retaining recess depressed inwardly is provided on a front surface of the retaining part; and part of the stop part extends into the retaining recess.

16. The connection terminal according to claim 15, wherein:

the retaining part is provided with a retaining recess bottom wall; and the retaining recess bottom wall is stop-fittable with the bottom end of the stop part along the radial direction of the terminal body.

17. The connection terminal according to claim 15, wherein:

the retaining part is provided with a retaining recess side wall; and the retaining recess side wall is stop-fittable with a side wall of the stop part along a lateral direction of the terminal body.

18. The connection terminal according to claim 15, wherein:

the retaining part is provided with a retaining recess rear wall;

the retaining recess rear wall is stop-fittable with the stop part along the axial direction of the terminal body.

19. The connection terminal according to claim 15, wherein the retaining recess extends rearwardly to form an opening at a top end wall of the retaining part; and the stop part extends from the opening into the retaining recess.

20. The connection terminal according to claim 15, wherein the retaining recess is a stamped structure.

* * * * *